US009373472B2

(12) United States Patent
Mills et al.

(10) Patent No.: US 9,373,472 B2
(45) Date of Patent: Jun. 21, 2016

(54) CIRCUIT BREAKER MODULE WITH PLUG-IN CIRCUIT BREAKERS

(71) Applicant: LABINAL, LLC, Denton, TX (US)

(72) Inventors: Patrick Wellington Mills, Bradenton, FL (US); James Michael McCormick, Bradenton, FL (US)

(73) Assignee: Labinal, LLC, Denton, TX (US)

( * ) Notice: Subject to any disclaimer, the term of this patent is extended or adjusted under 35 U.S.C. 154(b) by 34 days.

(21) Appl. No.: 14/488,701

(22) Filed: Sep. 17, 2014

(65) Prior Publication Data

US 2015/0083560 A1 Mar. 26, 2015

Related U.S. Application Data

(60) Provisional application No. 61/882,689, filed on Sep. 26, 2013.

(51) Int. Cl.
*H01H 9/02* (2006.01)
*H01H 71/02* (2006.01)
*H01H 9/04* (2006.01)

(52) U.S. Cl.
CPC ..... *H01H 71/0264* (2013.01); *H01H 9/04* (2013.01)

(58) Field of Classification Search
CPC ..... H01H 71/0264; H01H 9/04
USPC ..... 200/295, 293, 50.32–50.4, 400, 401, 200/500, 501, 303
See application file for complete search history.

(56) References Cited

U.S. PATENT DOCUMENTS

| | | | | |
|---|---|---|---|---|
| 4,153,055 | A | 5/1979 | Etes | |
| 5,000,317 | A | 3/1991 | Cich | |
| 5,343,179 | A | 8/1994 | Pipich et al. | |
| 7,597,578 | B2 * | 10/2009 | Adunka | H02B 1/056 200/295 |
| 7,804,201 | B1 | 9/2010 | Ledbetter | |
| 8,507,815 | B2 * | 8/2013 | Aletti | H01H 9/04 200/302.1 |
| 2006/0125583 | A1 | 6/2006 | Mills et al. | |
| 2012/0154987 | A1 | 6/2012 | Mills et al. | |
| 2015/0129555 | A1 * | 5/2015 | Jang | H01H 9/04 218/157 |

OTHER PUBLICATIONS

International Search Report filed in PCT/US2014/056046 mailed Dec. 30, 2014.

* cited by examiner

*Primary Examiner* — Edwin A. Leon
(74) *Attorney, Agent, or Firm* — Rankin, Hill & Clark LLP

(57) ABSTRACT

A circuit breaker module includes a faceplate with a number of passages and a number of circuit breakers, each circuit breaker including an operating mechanism, conductor assembly, and a housing assembly. Each circuit breaker housing assembly includes a first body, a second body, and a plurality of pins. The first body defines a cavity. The second body defines a cavity. The first body and the second body have complimentary shapes. At least one of the first body or the second body includes a plurality of pin cavities. The pins and pin cavities disposed in an alignment pattern. The first body and the second body are coupled to each other defining an enclosed space, the enclosed space structured to accommodate an operating mechanism and conductor assembly.

16 Claims, 4 Drawing Sheets

CIRCUIT BREAKER MODULE WITH PLUG-IN CIRCUIT BREAKERS

BACKGROUND OF THE INVENTION

1. Field of the Invention

The disclosed concept pertains generally to a circuit breaker module and, more particularly, to a circuit breaker module including a number of circuit breakers.

2. Background Information

Circuit breakers are used to protect electrical circuitry from damage due to an overcurrent condition, such as an overload condition or a relatively high level short circuit or fault condition between a power source (e.g., a line terminal) and a load. Circuit breakers are used, for example, in aircraft electrical systems where they not only provide over-current protection but also serve as switches for turning equipment on and off. Aircraft or subminiature circuit breakers, for instance, are typically relatively small to accommodate the relatively high-density layout of aircraft circuit breaker modules, which make circuit breakers for numerous circuits accessible to a user. Aircraft electrical systems can consist, for example, of hundreds of circuit breakers, each of which is used for a circuit protection function as well as a circuit disconnection function through a push-pull handle.

Each circuit breaker includes a non-conductive housing assembly that defines an enclosed space. The mechanical and electrical elements of the circuit breaker, e.g. an operating mechanism and a conductor assembly, are substantially disposed in the enclosed space. The circuit breaker housing assembly is known to include two bodies. The two housing assembly bodies were coupled via metallic bushing surfaces. The use of such bushings added to the cost of materials and manufacturing.

It is known to mount a number of conventional aircraft or aerospace circuit breakers in a module. The module includes a frame assembly defining an enclosed space in which the circuit breakers are disposed. The module further includes a generally planar faceplate. The faceplate made from a flexible or semi-flexible material has the disadvantage of being deformed. That is, the faceplate can flex and bow. This is especially true of faceplates that have a greater area.

Accordingly, circuit breaker housing assemblies need improved assembly elements. Further, circuit breaker module faceplates need enhanced rigidity.

SUMMARY OF THE INVENTION

These needs, and others, are met by at least one embodiment of the disclosed and claimed concept which provides a circuit breaker module including a faceplate with a number of passages and a number of circuit breakers, each circuit breaker including an operating mechanism, conductor assembly, and a housing assembly. Each circuit breaker housing assembly includes a first body, a second body, and a plurality of pins. The first body defines a cavity. The second body defines a cavity. The first body and the second body have complimentary shapes. At least one of the first body or the second body includes a plurality of pin cavities. The pins and pin cavities are disposed in an alignment pattern. The first body and the second body are coupled to each other defining an enclosed space, the enclosed space structured to accommodate an operating mechanism and conductor assembly.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
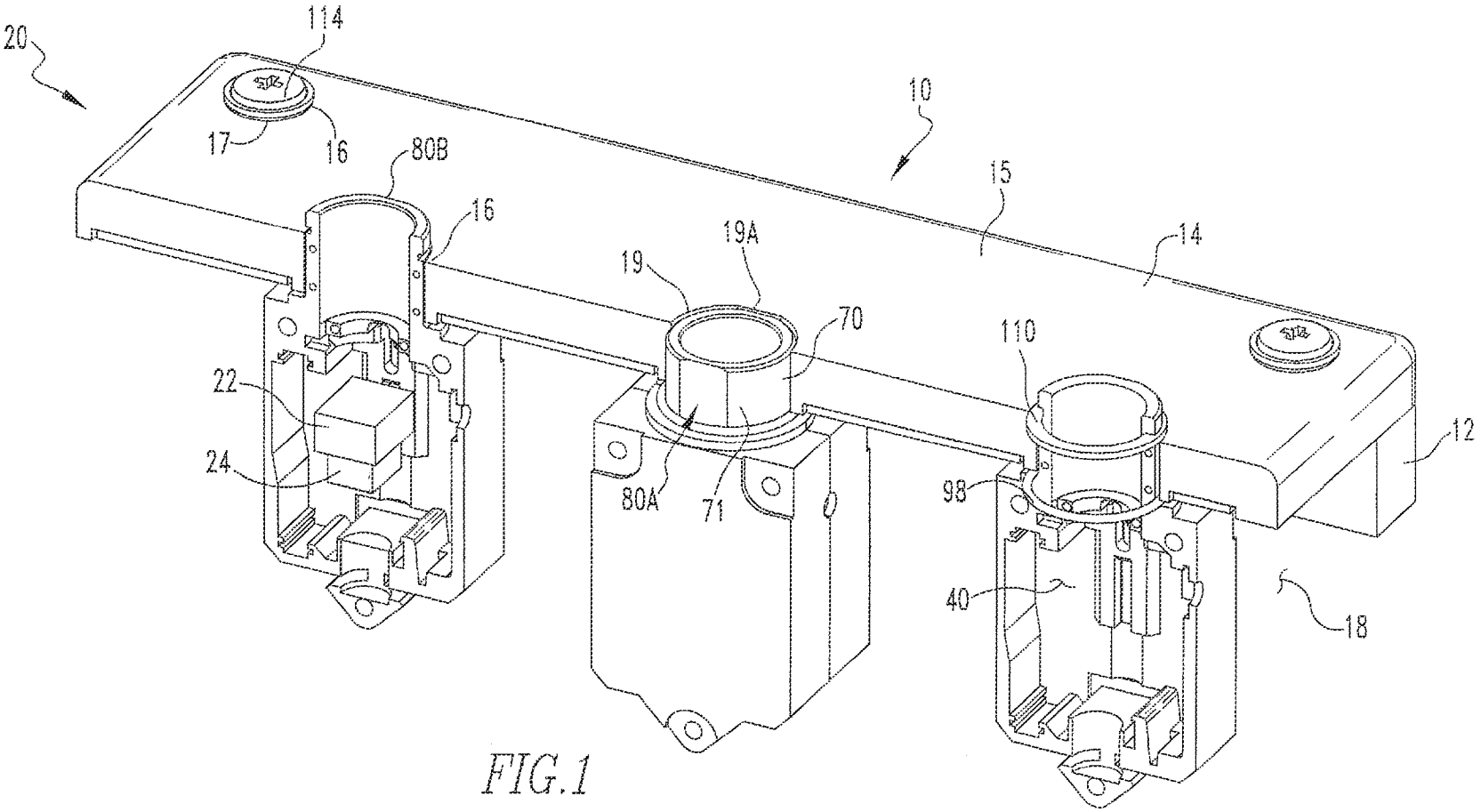
FIG. 1 is a partial isometric view of a circuit breaker module.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, the statement that two or more parts or components "engage" one another shall mean that the elements exert a force or bias against one another either directly or through one or more intermediate elements or components. Further, "selectively engage" means that an element moves between one or more positions and in one position the element "engages" another.

As used herein, the word "unitary" means a component is created as a single piece or unit. That is, a component that includes pieces that are created separately and then coupled together as a unit is not a "unitary" component or body.

As used herein, the term "number" shall mean one or an integer greater than one (i.e., a plurality).

As used herein, a "coupling assembly" includes two or more couplings or coupling components. The components of a coupling or coupling assembly are generally not part of the same element or other component. As such the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, an "alignment pattern" relates to the configuration and/or position of coupling components for elements having complimentary and/or similar shapes. That is, coupling components disposed in an "alignment pattern" are positioned so that the elements having complimentary and/or similar shapes are aligned when they are coupled. For example, two square elements having the same size and which are coupled by coupling components in an "alignment pattern" would be coupled so that the square elements are disposed in the same orientation and with their perimeters substantially aligned.

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." in that situation, the difference between the size of the components is even smatter whereby the amount of friction increases. If the element defining the opening and/or the component inserted into the opening are made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies.

As used herein, "dilatant" is not used to describe a material property. That is, as used herein, "dilatant" means a structural property wherein a structure becomes more rigid when pressure is applied thereto.

As used herein, a "support distribution pattern" means a pattern wherein support is generally evenly distributed over a surface.

As shown in FIG. 1, a circuit breaker module 10 includes a frame 12, a faceplate 14 (shown in part), and a number of circuit breakers 20. The frame 12 and the faceplate 14 define an enclosed space 18. In an exemplary embodiment, the circuit breakers 20 are aircraft, or subminiature, circuit breakers 20. As described below, the circuit breakers 20 include a collar 70 that is disposed about an actuator button (not shown). The faceplate 14 includes a number of passages 16. In an exemplary embodiment, the faceplate passages 16 are generally circular, with the exception noted below. The circuit breaker collars 70 have an outer radius, with the exception noted below, that generally corresponds to the radius of the faceplate passages 16. In this configuration, the circuit breakers 20 are substantially disposed in the circuit breaker module enclosed space 18 with the collars 70 extending through the faceplate passages 16.

Figure 2:
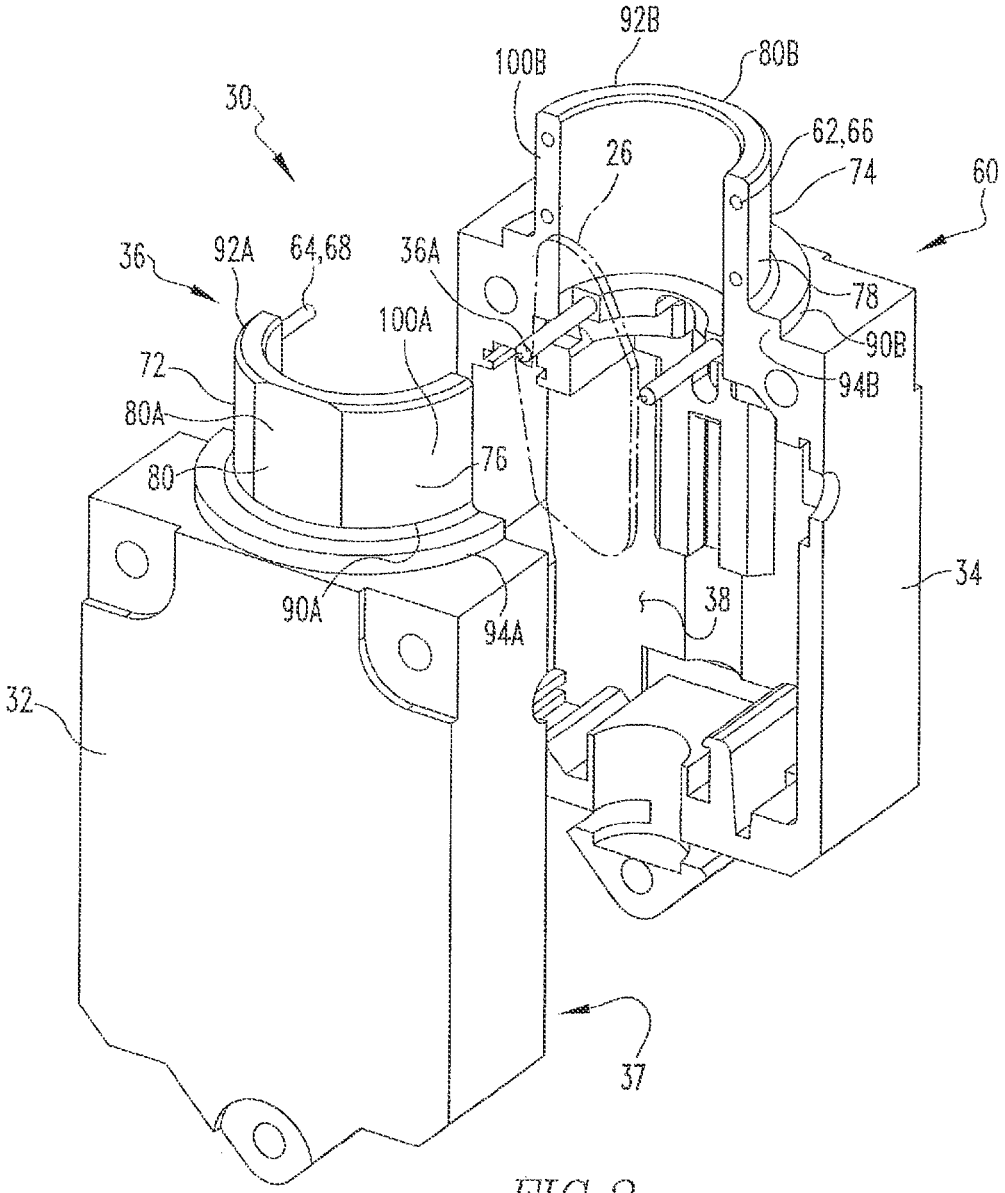
FIG. 2 is an exploded isometric view of a circuit breaker housing.
Figure 3:
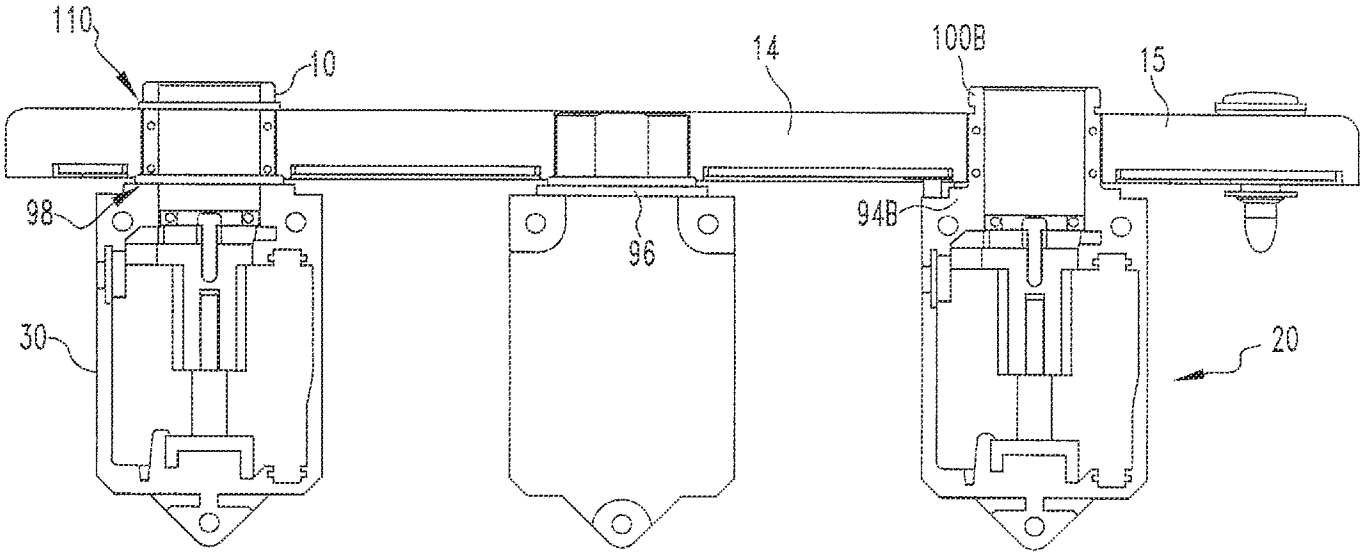
FIG. 3 is a partial cross-sectional side view of a circuit breaker module.

In an exemplary embodiment, the circuit breakers 20 include an operating mechanism 22, a conductor assembly 24 (both shown schematically), and a housing assembly 30. The operating mechanism 22 includes a number of latches 26 that maintain the operating mechanism in a selected configuration, e.g. an operating configuration prior to an over-current condition. As shown in FIG. 2, each circuit breaker housing assembly includes 30 a first body 32, a second body 34, and a plurality of pins 36. The first body 32 and the second body 34 have complimentary shapes. That is, as used herein, "complimentary shapes" mean that the perimeters of the bodies have a substantially similar size and shape. Each of the first body 32 and the second body 34 define a cavity 37, 38. The first body 32 and the second body 34 are structured to be coupled together with the cavities 37, 38 facing each other so that, when the first body 32 and the second body 34 are coupled, the cavities 37, 38 define a circuit breaker enclosed space 40 (FIG. 1). The circuit breaker enclosed space 40 is sized and shaped to substantially enclose the operating mechanism 22 and a conductor assembly 24.

The plurality of pins 36 are structured to align the first body 32 and the second body 34. That is, the plurality of pins 36 are coupling components that cooperate with a plurality of pin cavities 50, described below, disposed on one of or both, the first body 32 and the second body 34. The plurality of pins 36 and the pin cavities 50 are disposed in an alignment pattern. In an exemplary embodiment, the pins 36 are latching pins 36A. That is, an operating mechanism latch 26 is structured to engage a latching pin 36A. Thus, as used herein, a "latch pin" is a pin that is used as a latching surface for a circuit breaker operating mechanism 22. As such, when the pins 36 are latching pins 36A, the operating mechanism 22 selectively engages the latch pin 36A.

In an exemplary embodiment, the first body 32 and the second body 34 are molded bodies. Further, in an exemplary embodiment, the plurality of pins 36 are molded as part of either the first body 32 or the second body 34 (molded as part of first body 32 as shown in FIG. 2). That is, the pins 36 are unitary with one of the first body 32 or the second body 34. In this embodiment, the first body 32 or second body 34, without the unitary pins 36 includes a plurality of pin cavities 50. It is understood that, in an exemplary embodiment, there is one pin cavity 50 associated with each pin 36. The pin cavities 50 are disposed in a pattern corresponding to the pins 36 on the other first body 32 or second body 34. The first body 32 and the second body 34 are coupled by inserting the distal ends of the pins 36 into the pin cavities 50 and moving the first body 32 and the second body 34 adjacent to each other. In an exemplary embodiment, the first body 32 and the second body 34 are directly coupled at the perimeter when coupled. Further, the molded pins 36 do not include a metallic bushing or have such a bushing coupled thereto.

Figure 4:
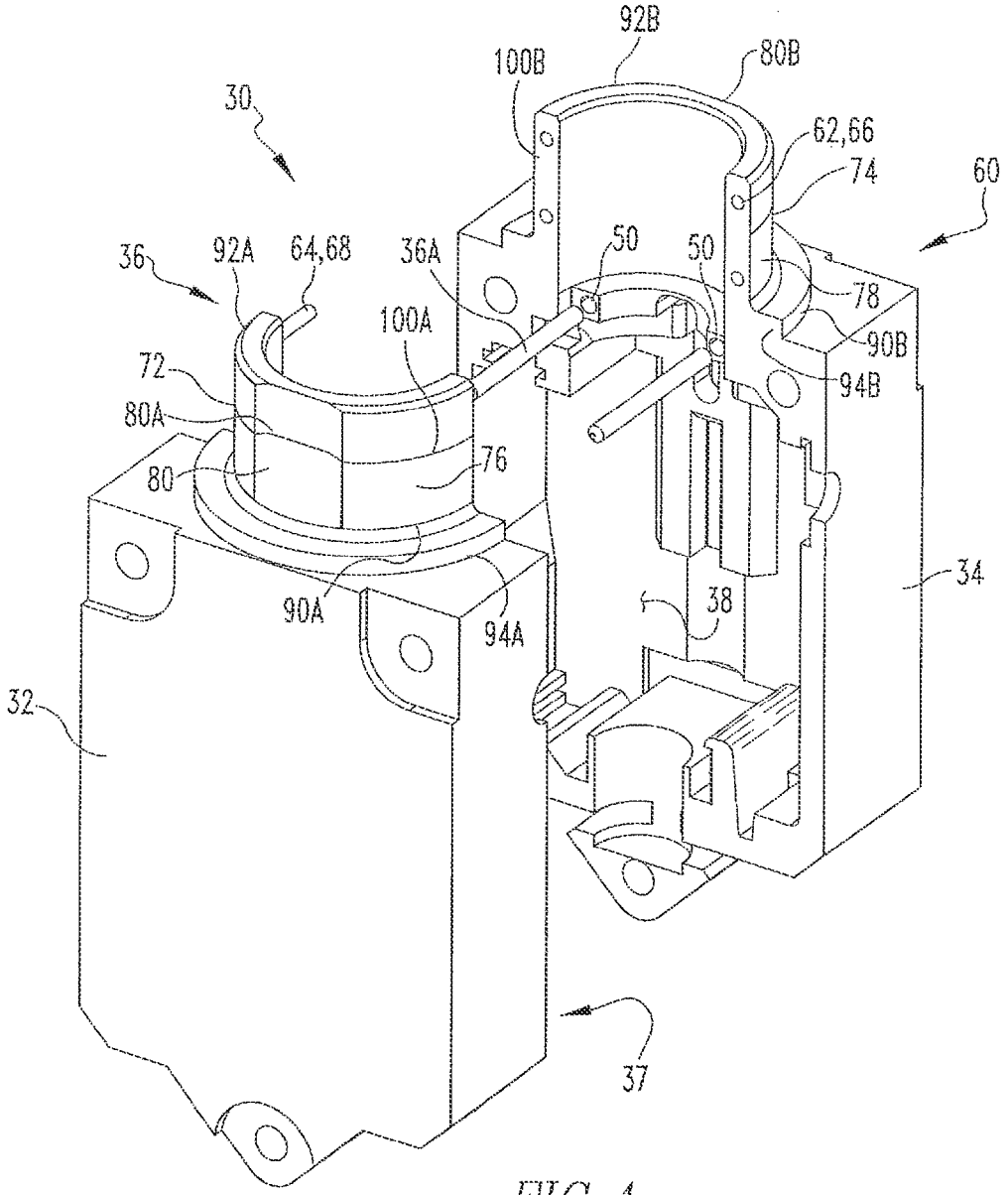
FIG. 4 is an exploded isometric view of an alternate embodiment of the circuit breaker housing.

In another exemplary embodiment, shown in FIG. 4, both the first body 32 and the second body 34 include a plurality of pin cavities 50. It is understood that the pin cavities 50 are disposed in an alignment pattern. In this embodiment, the pins 36 are separate from the bodies 32, 34. Further there is one pin 36 associated with each pair of pin cavities 50. The pins 36 are inserted into the pin cavities 50 on either the first body 32 or the second body 34. The other body 32 or 34 is then coupled to the body 32 or 34 to which the pins 36 are all ready attached.

In an exemplary embodiment, the first body 32 and the second body 34 further include a number of alignment components 60. As shown, the alignment components 60 include a number of first alignment components 62 and a number of second alignment components 64. In an exemplary embodiment, the first alignment components 62 are disposed on the first body 32 and the second alignment components 64 are disposed on the second body 34. The first alignment components 62 and the second alignment components 64 are disposed in a corresponding configuration. In an exemplary embodiment, the first alignment components 62 are lugs 66. As shown, the lugs 66 are, in an exemplary embodiment, generally semispherical. In this embodiment, the second alignment components 64 are hollows 68, cavities, that have a shape generally corresponding to the shape of the lugs 66. That is, in this embodiment, the hollows 68 are also generally semispherical. The alignment components 60 are, in an exemplary embodiment, disposed in an alignment pattern.

In an exemplary embodiment, the first body 32 and the second body 34 form a collar 70 (FIG. 1) having an outer surface 71. That is, in an exemplary embodiment, the first body 32 includes a first collar portion 72 and the second body 34 includes a second collar portion 74. Each collar portion 72, 74 is, in an exemplary embodiment, generally semi-cylindrical. When the first body 32 and the second body 34 are coupled, the collar portions 72, 74 form a passage that extends into the circuit breaker enclosed space 40. In an exemplary embodiment, the outer perimeters of the collar 70 are not circular. That is, each collar portion 72, 74 includes an outer surface 76, 78. In an exemplary embodiment, at least one of the first collar portion outer surface 76 and the second collar portion outer surface 78 includes a generally planar portion 80. The collar planar portion 80 extends generally parallel to the longitudinal axis of the collar 70. In an exemplary embodiment, both collar portions 72, 74 include a generally planar portion 80A, 80B on the outer surface 76, 78. In an exemplary embodiment, the collar planar portions 80A, 80B are disposed generally opposite each other.

In this configuration, the collar 70 acts as an orienting device. That is, a number of the faceplate passages 16 are circuit breaker passages 19 that are shaped to correspond to the shape of the collar outer surface 71. Thus, the faceplate circuit breaker passages 19 are generally cylindrical except for including at least one, and in an exemplary embodiment two, planar portions 19A (one shown, FIG. 1). The planar portions 19A of the faceplate circuit breaker passages 19 are positioned so that a circuit breaker 20 can only be oriented in one or two positions. That is, as shown, the collar planar portions 80A, 80B and the faceplate passage planar portions 19A are generally the same size. In this configuration, the circuit breakers 20 may be installed in two orientations. In an exemplary embodiment, the faceplate passage planar portions 19A however, are positioned so that the circuit breakers 20 are disposed generally parallel to each other.

Further, each collar portion 72, 74 include a proximal end 90A, 90B and a distal end 92A, 92B. Each collar portion proximal end 90A, 90B includes a generally radially extending flange 94A, 94B. When the first body 32 and the second body 34 are coupled, the collar flanges 94A, 94B form a shoulder 96. The shoulder 96, in an exemplary embodiment, is a seat for a resilient O-ring 98. Further, each collar distal end 92A, 92B includes a retaining ring groove 100A, 100B. When the first body 32 and the second body 34 are coupled, the collar retaining ring grooves 100A, 100B form a retaining ring groove 100 that extends about the collar 70. In an exemplary embodiment, the shoulder 96 and the retaining ring groove 100 are spaced a distance, i.e. an axial distance on the collar 70, to snugly correspond to the thickness of the faceplate 14. In an embodiment wherein an O-ring 98 is utilized, the shoulder 96 and the retaining ring groove 100 are spaced a distance so that, when an O-ring 98 is installed on the shoulder 96, the O-ring 98 and the retaining ring groove 100 are spaced a distance, i.e. an axial distance on the collar 70, to snugly correspond to the thickness of the faceplate 14.

The circuit breakers 20 are assembled with the operating mechanism 22 and the conductor assembly 24 disposed in the circuit breaker enclosed space 40. Each circuit breaker 20 is then disposed in the circuit breaker module enclosed space 18 with the collars 70 extending through the faceplate passages 16. As noted above, the orientation of the circuit breakers 20 is controlled by the location of the faceplate passage planar portions 19A. Further, in an exemplary embodiment, the circuit breaker housing assembly 30 further includes a retaining ring 110. When the retaining ring 110 (FIG. 1) is installed, the faceplate 14 is compressed. That is, the retaining ring 110 and the shoulder 96, or in an alternative embodiment the O-ring 98 disposed on the shoulder 96, engage the faceplate 14 thereby compressing the faceplate 14.

The faceplate 14 is a dilatant body 15 that is generally deformable in a direction normal to the plane thereof. Further, the faceplate passages 16 are disposed in a support distribution pattern. In this configuration, when the circuit breakers 20 are coupled to the faceplate 14, as described above, i.e. with the faceplate 14 compressed, the faceplate dilatant body 15 becomes more rigid and is less prone to deflection. In an exemplary embodiment, the faceplate passages 16 further include fastener passages 17. In this embodiment, the faceplate passages 16 and faceplate fastener passages 17 are disposed in a cooperative support distribution pattern. The faceplate 14 is coupled to the frame 12 by compressive fasteners, such as, but not limited to screws 114. When the screws 114 are drawn down on the faceplate 14, the areas about the faceplate fastener passages 17 are compressed thereby increasing the rigidity of the faceplate 14.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A miniature circuit breaker housing assembly for a miniature circuit breaker, said miniature circuit breaker including an operating mechanism and conductor assembly, said miniature circuit breaker housing assembly comprising:

a first body defining a first cavity, wherein the first body is molded and defines a plurality of pin cavities;

a second body defining a second cavity, wherein the second body is molded so as to include a plurality of pins that are unitary to the second body;

wherein said first body and said second body have complimentary shapes;

said pins and pin cavities disposed in an alignment pattern; and said first body and said second body coupled to each other such that the first cavity and the second cavity cooperate to define an enclosed pace that is structured to accommodate an operating mechanism and conductor assembly, wherein when the first body and the second body are coupled to each other, the plurality of pins are received in the respective plurality of pin cavities such that a metallic bushing is not coupled thereto.

2. The miniature circuit breaker housing assembly of claim 1 wherein:

a number of pins are latch pins; and said latch pins are selectively engaged by said operating mechanism.

3. The miniature circuit breaker housing assembly of claim 1 wherein:

said first body includes a number of first alignment components;

said second body includes a number of second alignment components; and said first alignment components and said second alignment components disposed in a corresponding configuration.

4. The miniature circuit breaker housing assembly of claim 3 wherein:

said first alignment components are lugs; and said second alignment components are hollows.

5. The miniature circuit breaker housing assembly of claim 1 wherein:

said first body includes a first collar portion with a first collar portion outer surface;

said second body includes a second collar portion with a second collar portion outer surface;

wherein, when said first body and said second body are coupled, said first collar portion and said second collar portion form a collar that defines a passage into said enclosed space;

said first collar portion and said second collar portion are each generally semi-cylindrical; and wherein at least one of said first collar portion outer surface and said second collar portion outer surface includes a generally planar portion.

6. The miniature circuit breaker housing assembly of claim 5 wherein:

each of said first collar portion outer surface and said second collar portion outer surface includes a generally planar portion; and wherein, when said first body and said second body are coupled, said first collar portion planar portion and said second collar portion planar portion are disposed generally opposite each other.

7. The miniature circuit breaker housing assembly of claim 5 wherein said circuit breaker is structured to be coupled to a generally planar faceplate, said faceplate including a number of passages corresponding to said collar, wherein said faceplate has a thickness, and wherein:

said first collar portion and said second collar portion each include a proximal end and a distal end;

each said first collar portion proximal end and said second collar portion proximal end each include a radial flange;

wherein, when said first body and said second body are coupled, said first collar portion flange and said second collar portion flange defines a shoulder extending about said collar;

each said first collar portion distal end and said second collar portion distal end includes a retaining ring groove;

each said shoulder and each said retaining ring groove spaced to snugly correspond to the thickness of said faceplate; and an O-ring disposed about said collar and disposed at said shoulder.

8. A circuit breaker module comprising: a faceplate including a number of passages;

a number of circuit breakers, each circuit breaker including an operating mechanism, conductor assembly, and a miniature circuit breaker housing assembly;

said operating mechanism includes a latch;

each miniature circuit breaker housing assembly including a first body and a second body;

said first body defining a first cavity, wherein the first body is molded and defines a plurality of in cavities;

said second body defining a second cavity, wherein the second body is molded so as to include a plurality of pins that are unitary to the second body;

wherein said first body and said second body have complimentary shapes;

said pins and pin cavities disposed in an alignment pattern; and said first body and said second body coupled to each other such that the first cavity and the second cavity cooperate to define an enclosed space, that is structured to accommodate an operating mechanism and conductor assembly, wherein when the first body and the second body are coupled to each other, the plurality of pins are received in the respective plurality of in cavities such that a metallic bushing is not coupled thereto.

9. The circuit breaker module of claim 8 wherein:

a number of pins are latch pins; and said latch pins are selectively engaged by said operating mechanism latch.

10. The circuit breaker module of claim 8 wherein:

said first body includes a number of first alignment components;

said second body includes a number of second alignment components; and said first alignment components and said second alignment components disposed in a corresponding configuration.

11. The circuit breaker module of claim 10 wherein:

said first alignment components are lugs; and said second alignment components are hollows.

12. The circuit breaker module of claim 8 wherein:

said first body includes a first collar portion with a first collar portion outer surface;

said second body includes a second collar portion with a second collar portion outer surface;

wherein, when said first body and said second body are coupled, said first collar portion and said second collar portion form a collar that defines a passage into said enclosed space;

said first collar portion and said second collar portion are each generally semi-cylindrical; and wherein at least one of said first collar portion outer surface and said second collar portion outer surface includes a generally planar portion.

13. The circuit breaker module of claim 12 wherein:

each of said first collar portion outer surface and said second collar portion outer surface includes a generally planar portion; and wherein, when said first body and said second body are coupled, said first collar portion planar portion and said second collar portion planar portion are disposed generally opposite each other.

14. The circuit breaker module of claim 12 wherein:

wherein said faceplate has a thickness, and wherein:

said first collar portion and said second collar portion each include a proximal end and a distal end;

each said first collar portion proximal end and said second collar portion proximal end each include a radial flange;

wherein, when said first body and said second body are coupled, said first collar portion flange and said second collar portion flange defines a shoulder extending about said collar;

each said first collar portion distal end and said second collar portion distal end includes a retaining ring groove;

each said shoulder and each said retaining ring groove spaced to snugly correspond to the thickness of said faceplate; and an O-ring disposed about said collar and disposed at said shoulder.

15. The circuit breaker module of claim 8 wherein:

said faceplate is a dilatant body that is generally deformable in direction normal to the plane thereof; and said faceplate passages including a number of fastener passages disposed in a support distribution pattern.

16. The circuit breaker module of claim 8 wherein:

said faceplate is a dilatant body that is generally deformable in direction normal to the plane thereof; and said faceplate passages including a number of circuit breaker passages disposed in a support distribution pattern.

* * * * *